US005579909A

United States Patent [19]

Deal

[11] Patent Number: 5,579,909

[45] Date of Patent: Dec. 3, 1996

[54] HEAVY DUTY METAL ELECTRONIC GUN LOCK BOX

[76] Inventor: Verron S. Deal, 3507 Pine Cone Cir., Clearwater, Fla. 34620

[21] Appl. No.: 232,723

[22] Filed: Apr. 25, 1994

[51] Int. Cl.[6] ..... B65D 85/00

[52] U.S. Cl. ..... 206/317; 206/1.5; 356/71

[58] Field of Search ..... 206/1.5, 317, 807; 70/63, 416; 356/71

[56] References Cited

U.S. PATENT DOCUMENTS

| | | | |
|---|---|---|---|
| 4,722,435 | 2/1988 | Mareels et al. | 206/1.5 |
| 5,111,755 | 5/1992 | Rouse | 70/63 |
| 5,118,175 | 6/1992 | Costello | 206/317 |
| 5,164,718 | 11/1992 | Cedergren | 70/63 |
| 5,168,994 | 12/1992 | Beletsky et al. | 206/317 |
| 5,172,575 | 12/1992 | Fisher | 206/317 |
| 5,233,404 | 8/1993 | Lougheed et al. | 356/71 |
| 5,236,086 | 8/1993 | Mac Taggart | 206/317 |
| 5,329,865 | 7/1994 | McWard | 70/63 |
| 5,344,010 | 9/1994 | Dyer et al. | 206/1.5 |

*Primary Examiner*—David T. Fidei
*Attorney, Agent, or Firm*—Fitch, Even, Tabin & Flannery

[57] ABSTRACT

A heavy duty metal box with a tamper resistant locking mechanism #4 used to store a loaded weapon or handgun. The box includes an embedded thumbprint recognition system including an optical scanner #2 and a numeric keypad #1 for a means of identifying a person as an authorized or unauthorized user. If authorized, the user will be given immediate access to the weapon or gun that is stored in the box. If file users identity cannot be recognized via the thumbprint on the optical scanner #2 or the numeric keypad #1 code or pin number they are determined to be unauthorized and file box will remain closed. Once the gun lock box's initial settings are completed and the initial thumbprints are scanned, only those recognized will be allowed to access the box.

1 Claim, 2 Drawing Sheets

PRIOR ART

HEAVY DUTY METAL ELECTRONIC GUN LOCK BOX

BACKGROUND

1. Field of Invention

Figure 1:
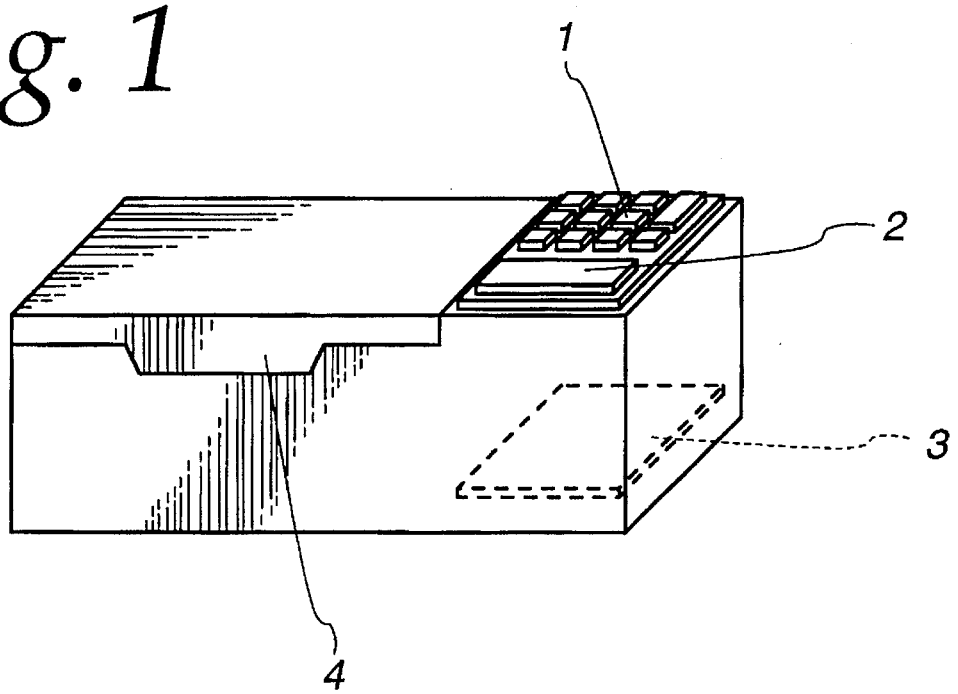

This invention relates to the gun locking protection and security field (Class 42/70) using thumbprint recognition technology (Class 356/71) as the primary method of access and security.

2. Description of Prior Art

There is a tremendous problem with possessing a loaded weapon or gun, in a home or business, that allows only certain people to access the weapon or gun without restricting the defensive reaction time. The only prior gun locking mechanisms were all solely mechanical involving a key, slide chamber locking device or some form of mechanism that could cause enough of a delay that people would not be willing to use it in fear of the fact that they could not gain access to the weapon or gun the minute they need it.

The main purpose for any of the above mentioned devices was to provide safety and typically prevent children from having the ability of firing the gun accidentally. The public purchases or possesses weapons or guns to protect themselves, their family and their property. If the protective device used to keep the weapon or gun safe from unauthorized users or children prevents the protector or authorized user from being able to access the weapon or gun in time for protection purposes then why even have the gun.

I developed a device that would not restrict or reduce the defensive reaction time but still offer complete security or restrict access to children and unauthorized users of the weapon or gun. This invention will allow the public to protect themselves, their family and their property and at the same time keep the children safe.

The invention I refer to is a gun lock box. It will keep the gun or weapon safe from children and unauthorized users but allow for quick and easy access by the simple touch of a thumb. This invention is designed to save the lives of thousands of children that fall victim to accidental shootings and not to mention the people that have been unable to access a loaded gtm in time to defend themselves.

3. Objects and Advantages

The following statements are the objects and advantages of this invention. Starting off with the least important and ending with the most important advantages.

A) The use of the metal locking box enables the public to store the weapon or gun out in the open, on a dresser, a counter, by the bed or where ever they prefer to display the weapon without the fearing who would make notice of the weapon and be intimidated or in fear of the surroundings.

B) The metal box will in no way, shape or form expose the identity of what is being stored inside the box.

C) There will be several versions of the manufactured box which will allow one, several or many guns to be stored in one box with a varied amount of thumbprints to be recognized.

D) The thumbprint recognition system and optical scanner will enable a certain number of thumbprints to be recognized and allow only those recognized access to the box.

E) There will be a keypad next to the embedded optical scanner in the event that the thumbprint will not allow access. This is the secondary method of emergency access. The access time via the keypad is greatly slower than the thumbprint recognition system. That is why it is the secondary method not the primary method of accessing the box.

F) This invention or method of securing a weapon or gun will greatly increase the defense reaction time allowing access to a weapon or gun much faster to the people that do use a prior mechanical method of securing the weapon G) The invention could save valuable seconds to even minutes in defensive reaction time which could inadvertently save the lives of potential victims of crimes.

H) The invention will prevent children or unauthorized users from gaining access to the loaded weapon, therefore, once again saving lives.

DRAWINGS FIGURES

The following statements are explanations, descriptions or overviews of the figures:

FIG. 1: This is a scaled-down frontal picture of the invention, the Gun Lock Box, with the lid closed.

Figure 2:
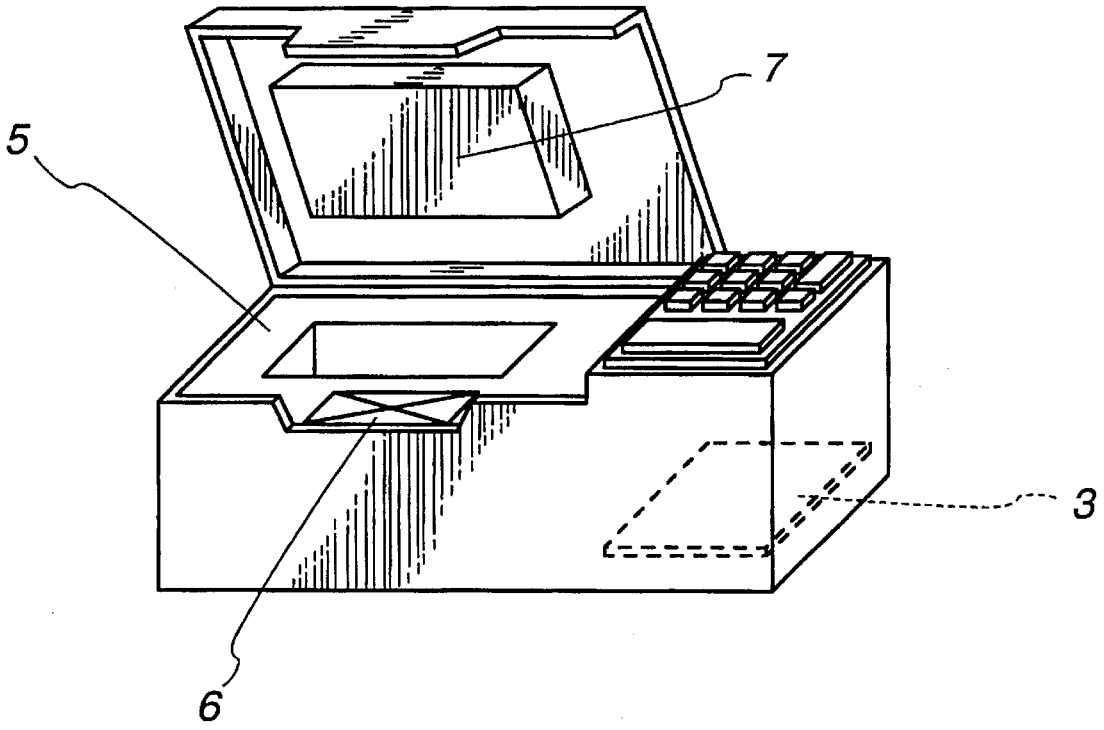

FIG. 2: This is a scaled-down frontal view of the invention, the Gun Lock Box, with the lid open.

Figure 3:
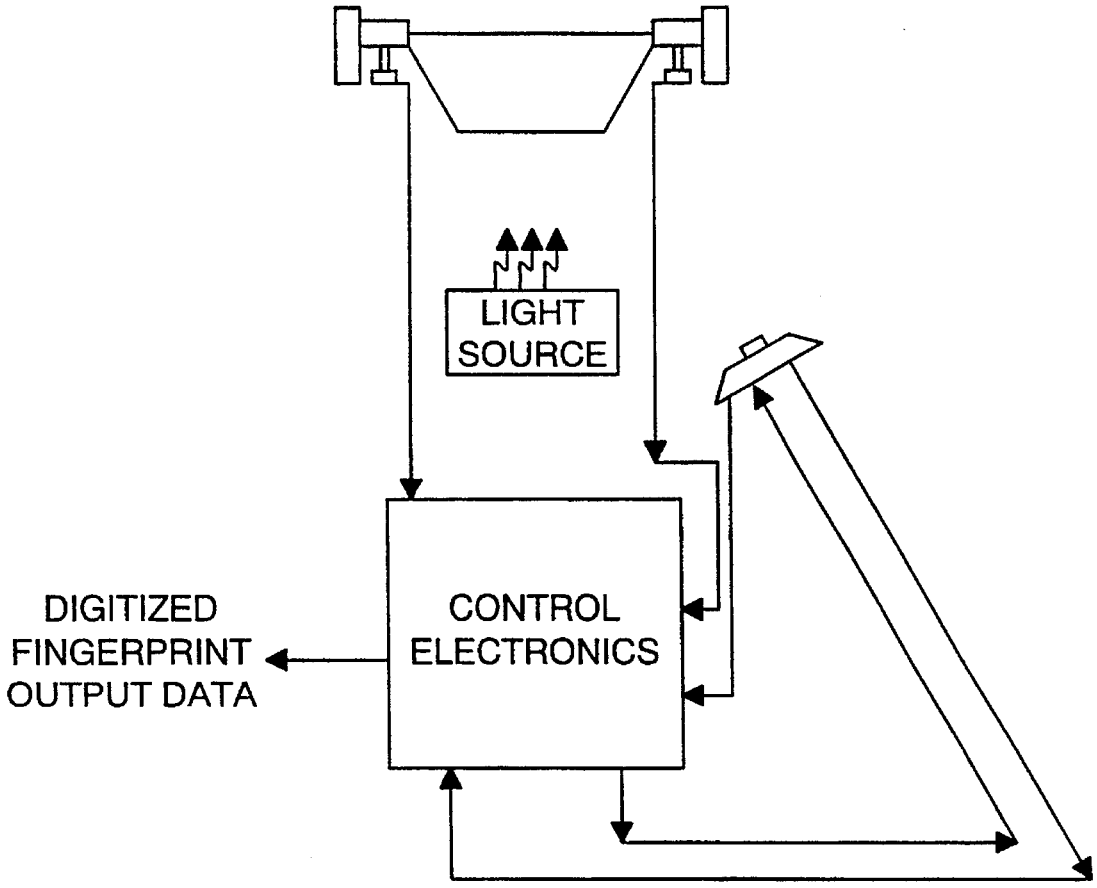

FIG. 3: This diagram is considered "prior art". We are using this diagram which was duplicated from U.S. Pat. No. 5,233,404 due to the fact that we are negotiating the use of the components that are needed for the optical scanning. The picture represents the components and process for the optical scanner that will be embedded in our PC board. This will allow us to purchase a component market ready and tested rather than building the components ourselves.

DESCRIPTION OF DIAGRAMS 1 TO 3

The projected appearance of the invention is illustrated in FIG. 1. This is a sealed down frontal view that shows the box in the closed state. The box will be made out of a heavy tamper resistant metal. The box will utilize a tamper resistant locking mechanism to secure the contents of the box. The only exposed electronics will be the optical scanner prism holder #2, the 10 digit keypad #1 and the plain side of the PC board #3 with a cover on it.

In FIG. 2 we show again a sealed down frontal view but this time the gun lock box is in an open state. This exposes for the most part the 1" foam padding #5 that is lining the bottom portion of the box and one piece on the lid. The foam piece on the lid #7 fits inside the foam on the bottom portion to act as a foam lid #5. This forms a complete enclosed foam box on the inside. On the inside we have allowed room on the right hand side of the box to allow for the components of the optical seanner #2 and the circuitry for the PC board #3. The PC board #3 contains all of the following components: 286 CPU, a ROM chip with my software programmed on chip, control circuitry, 10 digit keypad #1, optical seanning unit #2, power supply, adapter and battery back up circuit. We have not decided on what style of locking mechanism #4 to include in the box. That is why it states on the diagram a space allowing for locking mechanism #6.

FIG. 3 is duplicated from prior art on U.S. Pat. No. 5,233,404. This is an illustration of the process and the components for the optical scanning unit #2 that we will purchase to embed in our invention on the PC board #3.

OPERATION OF FIGS. 1 TO 3

The function and operation of the invention is to serve as a means of storing a loaded weapon or gun without creating a greater risk to children or unauthorized users. A person would put a loaded gun on the inside of the box. The foam padding #5 & 7 would hold the weapon or gun securely in place so it would not freely move around on the inside of the box. For the initial settings on the box a person would be given specific instructions on how to scan the thumbprints for the first time. There will be software programmed on the ROM chip which is on the PC board #3. The software will be responsible for commanding and controlling the optteal scanner #2 to capture the image of the thumbprint. The image will then be stored on the ROM clip until needed for recognition at a later date. The software is also responsible for the I/O to and from the numeric keypad #1, maintaining and storing the code or pin number. Once the thumb is placed on the optical scanner's prism #2, the thumb would be scanned three times for verification. Depending on the model that was purchased, several different thumbprints can be recognized and scanned for the initial set up. After the thumbprint scanning is complete the person must select a code or a pin number on the numeric keypad #1 as a back up method of accessing the box.

At this point no other maintenance is required to use the box. The box will be solar powered and have a battery backup circuit as a secondary means of providing power for the circuitry. When access is needed the person would place their thumb on the optical scanner prism #2. The thumb will be scanned and the image received will be compared to the initial allowable thumbprints in memory, if it is determined to be a match, the lid will spring open and expose the weapon or gun.

If the thumbprint cannot be recognized, then there is one alternative means of gaining access to the weapon which is through the 10 digit keypad #1. The code or pin number is the only other means of accessing the box. If the need arises to reset the box, this can be done via the keypad #1 as long as file code or pin number is used. You can add or delete thumbprints that are kept in memory at any point in time.

SUMMARY, RAMIFICATIONS AND SCOPE

The present invention allows for access and use of the weapon or gun. The invention involves a total of a couple of seconds before access is granted, it is that simple!

We will have several models including: a Single Gun Home Unit, a Multiple Gun Home Unit, a Single Gun Commercial Unit, a Multiple Gun Commercial Unit, the Excessive Force Police Unit and the Single Shotgun Unit. This we feel will suit all of the primary needs of the general public.

Although figures were included in this application for a patent, the figures are the projected appearance of the invention. The prototype is still in development and changes to the structural design may be necessary.

I claim:

1. A secure box for storing predetermined articles which enables relatively quick authorized entry, the box comprising:

a generally rectangular housing, at least partially open on one side, defining an opening;

a lid, rotatably mounted relative to said housing for closing said opening;

an optical scanner, disposed adjacent said opening for optically scanning fingerprints;

a fingerprint recognition system including means for storing predetermined fingerprints and generating an unlock signal when the fingerprint scanned by said optical scanner matches a predetermined stored fingerprint; and a locking mechanism for releasably locking said lid to said housing when said lid is closed and automatically releasing said lid in response to said unlock signal from said fingerprint recognition system.

* * * * *